US006989636B2

(12) United States Patent
Cok et al.

(10) Patent No.: US 6,989,636 B2
(45) Date of Patent: Jan. 24, 2006

(54) METHOD AND APPARATUS FOR UNIFORMITY AND BRIGHTNESS CORRECTION IN AN OLED DISPLAY

(75) Inventors: Ronald S. Cok, Rochester, NY (US); James H. Ford, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/869,009

(22) Filed: Jun. 16, 2004

(65) Prior Publication Data

US 2005/0280615 A1 Dec. 22, 2005

(51) Int. Cl.
*G09G 3/10* (2006.01)
*G09G 3/30* (2006.01)

(52) U.S. Cl. ..... 315/169.3; 345/77

(58) Field of Classification Search .. 315/169.2–169.3; 345/214, 76–77; G09G 3/10, 3/30
See application file for complete search history.

(56) References Cited

U.S. PATENT DOCUMENTS

| | | | | |
|---|---|---|---|---|
| 6,081,073 | A | 6/2000 | Salam | 315/169.2 |
| 6,414,661 | B1 | 7/2002 | Shen et al. | 345/82 |
| 6,473,065 | B1 | 10/2002 | Fan | 345/82 |
| 6,498,592 | B1 * | 12/2002 | Matthies | 345/1.1 |
| 6,661,180 | B2 * | 12/2003 | Koyama | 315/169.3 |
| 6,914,390 | B2 * | 7/2005 | Koyama | 315/169.3 |
| 2002/0030647 | A1 | 3/2002 | Hack et al. | 345/82 |
| 2002/0167471 | A1 * | 11/2002 | Everitt | 345/76 |
| 2004/0239595 | A1 * | 12/2004 | Vulto et al. | 345/76 |

FOREIGN PATENT DOCUMENTS

EP 0905673 3/1999

* cited by examiner

*Primary Examiner*—Thuy Vinh Tran
(74) *Attorney, Agent, or Firm*—Andrew J. Anderson

(57) ABSTRACT

A method for the correction of brightness and uniformity variations in OLED displays, comprising: a) providing an OLED display having a plurality of light-emitting elements with a common power signal and local control signals; b) providing a digital input signal for displaying information on each light-emitting element, the signal having a first bit depth; c) transforming the digital input signal into a transformed digital signal having a second bit depth greater than the first bit depth; and d) correcting the transformed signal for one or more light-emitting elements of the display by applying a local correction factor to produce a corrected digital signal. In accordance with various embodiments, the present invention may provide the advantages of improved uniformity in a display that reduces the complexity of calculations, maintains a consistent bit-depth for all light-emitting elements, provides a pre-determined output brightness, improves the yields of the manufacturing process, and reduces the electronic circuitry needed to implement the uniformity calculations and transformations.

28 Claims, 8 Drawing Sheets

METHOD AND APPARATUS FOR UNIFORMITY AND BRIGHTNESS CORRECTION IN AN OLED DISPLAY

FIELD OF THE INVENTION

The present invention relates to OLED displays having a plurality of light-emitting elements and, more particularly, correcting for non-uniformities in the display.

BACKGROUND OF THE INVENTION

Organic Light Emitting Diodes (OLEDs) have been known for some years and have been recently used in commercial display devices. Such devices employ both active-matrix and passive-matrix control schemes and can employ a plurality of light-emitting elements. The light-emitting elements are typically arranged in two-dimensional arrays with a row and a column address for each light-emitting element and having a data value associated with each light-emitting element to emit light at a brightness corresponding to the associated data value. However, such displays suffer from a variety of defects that limit the quality of the displays. In particular, OLED displays suffer from non-uniformities in the light-emitting elements. These non-uniformities can be attributed to both the light emitting materials in the display and, for active-matrix displays, to variability in the thin-film transistors used to drive the light emitting elements.

A variety of schemes have been proposed to correct for non-uniformities in displays. U.S. Pat. No. 6,081,073<entitled "Matrix Display with Matched Solid-State Pixels" by Salam granted Jun. 27, 2000 describes a display matrix with a process and control means for reducing brightness variations in the pixels. This patent describes the use of a linear scaling method for each pixel based on a ratio between the brightness of the weakest pixel in the display and the brightness of each pixel. However, this approach will lead to an overall reduction in the brightness of the display and a reduction and variation in the bit depth at which the pixels can be operated.

U.S. Pat. No. 6,414,661 B1 entitled "Method and apparatus for calibrating display devices and automatically compensating for loss in their efficiency over time" by Shen et al issued Jul. 2, 2002 describes a method and associated system that compensates for long-term variations in the light-emitting efficiency of individual organic light emitting diodes in an OLED display device by calculating and predicting the decay in light output efficiency of each pixel based on the accumulated drive current applied to the pixel and derives a correction coefficient that is applied to the next drive current for each pixel. The compensation system is best used after the display device has been calibrated to provide uniform light output. This patent provides a means for correcting the non-uniformities through the use of a look-up table. However, this approach does not reduce variation and reductions in bit-depth for the various pixels in the display and requires a large lookup table and complex calculation and circuit to implement.

U.S. Pat. No. 6,473,065 BI entitled "Methods of improving display uniformity of organic light emitting displays by calibrating individual pixel" by Fan issued Oct. 29, 2002 describes methods of improving the display uniformity of an OLED. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. The technique uses a combination of look-up tables and calculation circuitry to implement uniformity correction. However, this approach uses complex and large electronic means to implement, and also suffers from reduced and variable bit-depth in display gray-scale.

Other techniques rely upon complex sensing and driving circuitry to provide uniformity correction. For example, U.S. 20020030647 entitled "Uniform Active Matrix OLED Displays" by Hack et al published Mar. 14, 2002 describes such a technique. In this design, an active matrix display comprises an array of pixels, each pixel including an organic light emitting device and at least one thin film transistor. A uniformity correction circuit that is capable of producing a selected pixel brightness is connected to the array of pixels. The uniformity correction circuit is capable of maintaining the brightness of the pixels in a range that does not vary, for example, by more than about 5–10% from their selected brightness values. In other examples, improved uniformity is achieved through complex pixel driving circuits in each pixel. For example, see EP0905673 entitled "Active matrix display system and a method for driving the same" by Kane et al published Mar. 31, 1999. These approaches can unfavorably reduce the area in the OLED display available for emitting light, reduce manufacturing yields, and are subject to uniformity variation in the pixel circuits themselves.

There is a need, therefore, for an improved method of providing uniformity in an OLED display that overcomes these objections.

SUMMARY OF THE INVENTION

The need is met according to the present invention by providing a method for the correction of brightness and uniformity variations in OLED displays, comprising: a) providing an OLED display having a plurality of light-emitting elements with a common power signal and local control signals; b) providing a digital input signal for displaying information on each light-emitting element, the signal having a first bit depth; c) transforming the digital input signal into a transformed digital signal having a second bit depth greater than the first bit depth; and d) correcting the transformed signal for one or more light-emitting elements of the display by applying a local correction factor to produce a corrected digital signal.

ADVANTAGES

In accordance with various embodiments, the present invention may provide the advantage of improved uniformity in a display that reduces the complexity of calculations, maintains a consistent bit-depth for all light-emitting elements, provides a predetermined output brightness, improves the yields of the manufacturing process, and reduces the electronic circuitry needed to implement the uniformity calculations and transformations.

DETAILED DESCRIPTION OF THE INVENTION

Figure 1:
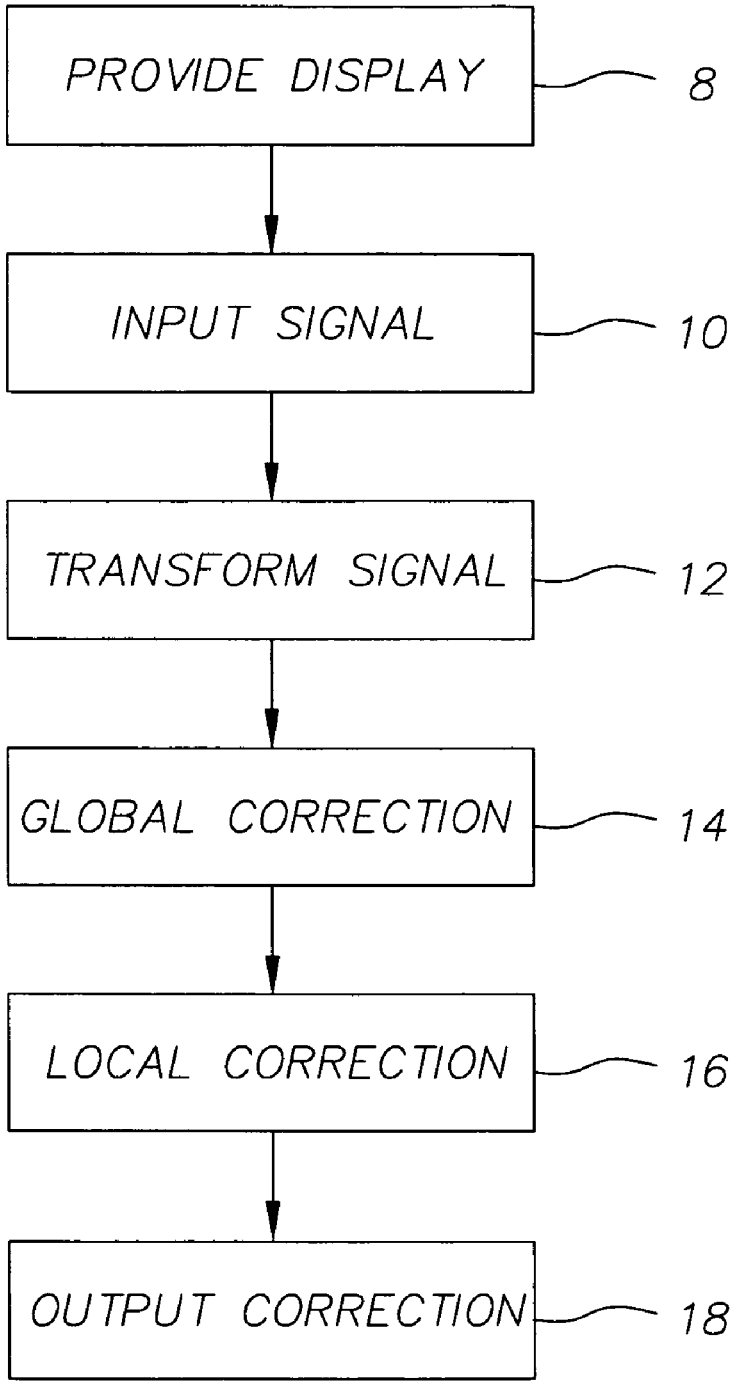
FIG. 1 is a flow diagram illustrating the method of the present invention.

Referring to FIG. 1, the present invention is directed to a method for the correction of brightness and uniformity variations in OLED displays, comprising the steps of providing 8 an OLED display having a plurality of light-emitting elements with a common power signal and local control signals; providing 10 a digital input signal for displaying information on each light-emitting element, the signal having a first bit depth; transforming 12 the digital input signal into a transformed digital signal having a second bit depth greater than the first bit depth; integer scaling 14 the transformed signal by a global correction factor for all light-emitting elements to produce a globally corrected signal; integer scaling 16 the globally corrected signal for one or more light-emitting elements of the display by a local correction factor to produce an output 18 corrected signal.

An integer scaling operation is an operation in which an input integer value is multiplied by an integer to form a second output integer value. Such operations are simple to implement in hardware and do not involve complex floating point calculations or division operations that are difficult or expensive to construct in conventional integrated circuits. Moreover, the use of an integer multiplier greatly reduces the need for large look-up tables in providing functional mathematical transformations. For example, an OLED display having 256 rows and 256 columns, three colors, and an 8-bit signal value, will require approximately 50 Mbytes of storage data to store a correction value for each color of each light-emitting element at each possible signal value. While integrated circuits available today can readily achieve these storage densities, they cannot easily integrate storage of the needed density and speed into the controllers used for displays at the required low cost. The design of the current invention requires less than 500 kBytes for a three-color system; this is readily achievable at the required costs. Moreover, the global and local corrections used in the present invention may be combined into a single operational step, further reducing the hardware needs.

Figure 2:
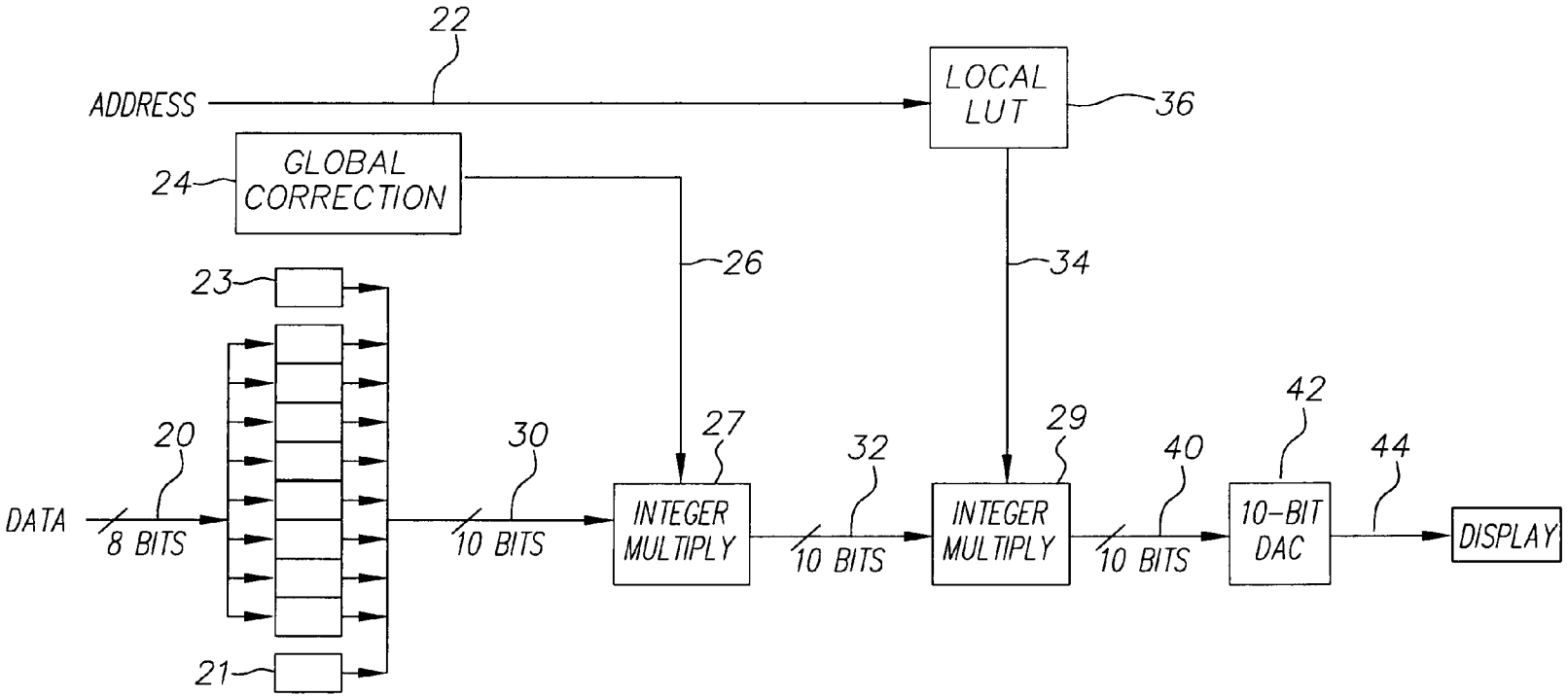
FIG. 2 is a schematic diagram illustrating an embodiment of the present invention.

Referring to FIG. 2, a simple embodiment of the present invention is illustrated. A digital input data signal 20 is input with an address value 22. A global correction factor 26 is stored in a memory 24. The digital input data signal 20 is transformed from the input bit-depth (shown as eight bits) to a larger bit-depth (shown as ten bits) digital data signal 30. This is readily accomplished by adding one bit 21 to the least significant bit of the digital input signal 20, thereby forming a nine-bit value for which each digital input value 20 is effectively multiplied by two, and adding one bit 23 to the most significant bit of the digital input signal 20 thereby forming a digital data signal having a larger bit-depth, ten-bit integer whose values are even and range from 0 to 510. The larger bit-depth digital data signal 30 is multiplied by the global correction factor 26 using integer multiplier 27 to form a globally corrected 10-bit signal 32. A local correction value 34 is stored in a look-up table 36 and addressed by the input address value 22. The globally corrected larger bit-depth digital data signal 32 is multiplied by the local correction value 34 using integer multiplier 29 to form a corrected digital signal 40 having a larger bit-depth than the digital input signal 20. While the global correction is illustrated as being performed prior to the local correction, the order of global and local correction steps may be interchanged to optimize the dynamic range of the correction and the use of the available bits in the signal. The corrected signal is then converted through a 10-bit digital-to-analog converter 42 to form a driving signal 44 suitable for driving the OLED display. Additional driving circuits may be combined with converter 42 to provide suitable power, data, and control signals for the OLED display. A separate circuit may be provided for each color in a color display.

Figure 3:
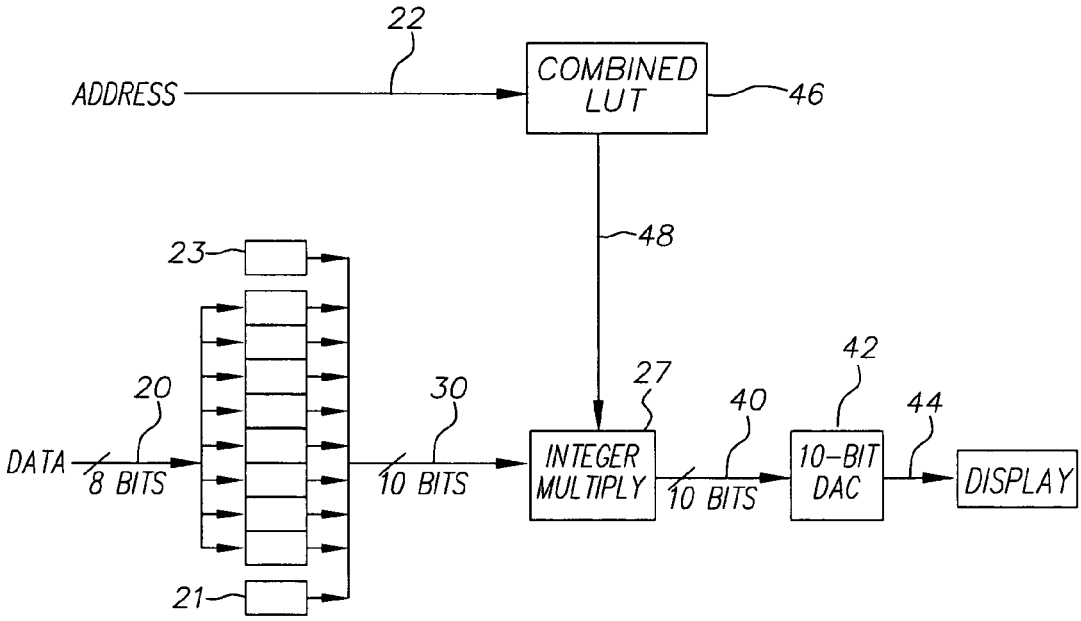
FIGS. 3–8 are schematic diagrams illustrating alternative embodiments of the present invention.

The two-step correction described above may be combined into a single operational step process. Referring to FIG. 3, the look-up table 46 has a combined correction value 48 applied to the first integer multiplier 27 to form the larger bit-depth corrected digital signal 40. However, the range of the combined multiplication may be larger than the two-step process, and hence may be slower.

As is taught in the prior art, if a light-emitting element having reduced efficiency (and hence non-uniformity) outputs only 150 cd/m$^2$ when driven by a signal with a code value intended to output 200 cd/m$^2$, the signal may be corrected by multiplying the code value by the ratio of the desired output by the actual output, in this example, 200/150 or 1.333 (for simplicity, presuming a linear relationship between code value and brightness). For example, it may be desired to output a brightness of 200 cd/m$^2$ corresponding to a maximum signal code value (e.g., 255 for an eight bit signal). In this case, however, any corrected code value above 191 (i.e., 255/1.333) can be set only to the maximum code value of 255, and cannot be properly corrected. Thus, there are only 191 different possible output values. This is a reduced bit depth that may result in contouring (reduced gray scale) in display of an image. Further, if the maximum code value corresponds to the maximum drive voltage, the inefficient light-emitting element cannot be corrected. In the prior art, this is addressed by using an uncorrected code value that is less than the maximum code value, and that corresponds to a drive voltage that is less than the maximum drive voltage. Thus, when the code value is corrected it may still be within the bit depth range and correspond to an obtainable drive voltage. For example, a code value of 191 may be intended to provide an output of 200 cd/m$^2$. When corrected, the code value of 191 may be less than or equal to 255, thus driving the voltage to a higher voltage in order to obtain an output of 200 cd/m$^2$. However, the available bit depth of the signal would still be limited to only 191 different possible output values.

According to the present invention, the light-emitting element is scaled to a larger bit-depth when performing the uniformity correction, thereby enabling both the desired brightness and bit-depth to be obtained. Using the example above, a code value of 200 may be transformed to a value of 400, and then multiplied by 1.333 to provide a corrected code value of 533. The code values having an expanded bit depth must be converted to a suitable driving signal for the display at the expanded bit depth to maintain the advantage of the larger bit-depth, for example using a 10-bit digital-to-analog converter to drive the OLED display. Moreover, if the 10-bit digital-to-analog converter has a wider driving range than the range of the 8-bit signal value, the non-uniformity may be corrected. The integrated circuit hardware necessary to accomplish these calculations is well-known in the prior art.

Means to measure the brightness of each light-emitting element in a display are known and described, for example, in the references provided above. In a particular embodiment, systems and methods as described in copending, commonly assigned U.S. Ser. No. 10/858,260, filed Jun. 1, 2004, may be employed, the disclosure of which is incorporated by reference herein. For example, a uniformity correction value may be found by calculating the average brightness of the display with a nominal digital input signal and wherein the global correction factor is a multiplication factor equal to the desired brightness of the display at the nominal digital input signal divided by the average brightness of the display at the nominal digital input signal. Alternatively, given the brightness of each light-emitting element and a desired brightness for the display, the global correction factors for each light-emitting element in the display can be calculated by finding the brightest light-emitting element in the display. The global correction factor is then the desired brightness divided by the brightest light-emitting element. Note that if the brightest light-emitting element is brighter than the desired brightness of the light-emitting element, then the correction factor must reduce the brightness of the light-emitting element (that is the global correction factor is less than 1). Integer multiplications using fractions are readily accomplished using multipliers having a bit range greater than the larger of the two input values. Such multiplication techniques are well-known in computer science. According to the present invention, division or floating point operations are not required to achieve the overall brightness and uniformity requirements of a display.

The local correction factor associated with each light-emitting element may be found by calculating the local brightness of a light-emitting element with a nominal digital input signal and wherein the local correction factor is a multiplication factor equal to the desired brightness of the light-emitting element at the nominal digital input signal divided by the local brightness of the display at the nominal digital input signal. The global correction factor should first be applied to each light-emitting element and then the local correction factor necessary to cause each light-emitting element to output the desired brightness calculated. The correction factor will be greater than one, because the global correction factor was calculated using the brightest light-emitting element. The local correction factor will be the desired brightness divided by the brightness of the globally corrected light-emitting element. The local correction factor can be combined with the global correction factor by multiplying them together, thereby forming a combined correction factor.

In accordance with a preferred embodiment of the present invention, to fully maintain the signal bit depth, the number of bits added to the least significant bits of the digital input value must be at least as large as the absolute value of the base 2 logarithm of the combined correction factor. That is, if a combined correction factor for a light-emitting element is a multiplication by ½, the number of bits added to the least significant bits of the digital input value must be at least 1. If a combined correction factor for a light-emitting element is a multiplication by ¼, the number of bits added to the least significant bits of the digital input value must be at least 2. If this restriction is not accommodated, the resulting bit-depth will be reduced, but may still provide an advantage relative to a signal with no additional bits.

If, on the other hand, the combined correction value is greater than one, that is the light-emitting element must become brighter, the number of bits added to the most significant bit of the digital input signal must be equal to or larger than the base 2 logarithm of the combined correction factor (again, to fully maintain the signal bit depth in accordance with preferred embodiments of the present invention). For example, if a combined correction factor for a light-emitting element is a multiplication by 2, the number of bits added to the most significant bits of the digital input value must be at least 1. If a combined correction factor for a light-emitting element is a multiplication by 4, the number of bits added to the least significant bits of the digital input value must be at least 2. If this restriction is not accommodated, the resulting bit-depth will be reduced (but again, may still provide an advantage relative to a signal with no additional bits).

The calculation of the global correction factor may also be performed using the brightness of the dimmest light-emitting element in the array or the average brightness of all of the light-emitting elements in the array. In these cases, the global and local correction factors may each change, but the combined correction does not.

Figure 4:
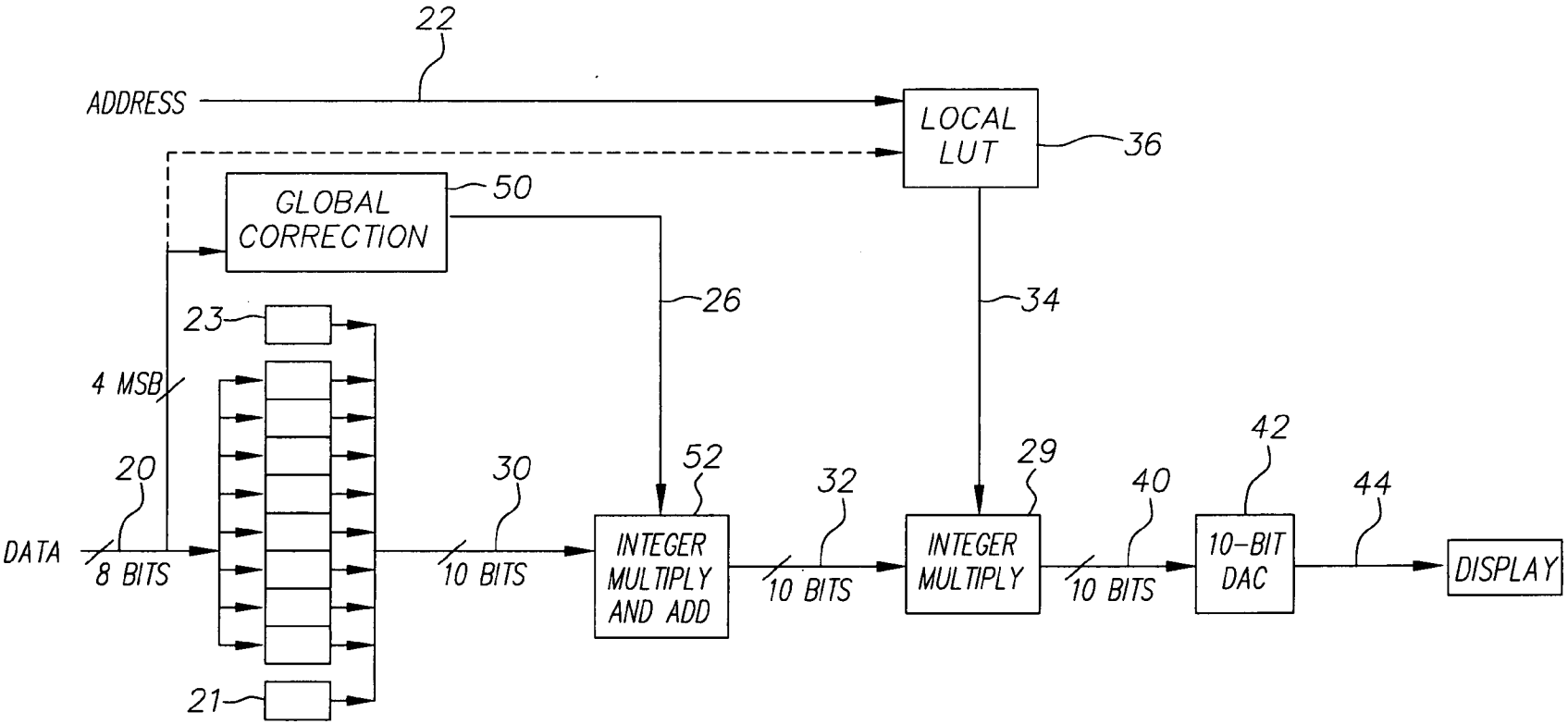

The brightness of an OLED light-emitting element is not always linearly related to the code values supplied to the display. Although the driving circuits used in such displays provide a functional transform in the relationship between the code values and the associated light-emitting element brightness, the desired correction factors for a light-emitting element may vary in non-linear ways at different brightness levels. Experiments performed by applicant have taught this is especially true for non-uniform light-emitting elements that, by definition, do not behave as desired or expected. Hence, it is useful to provide a variable global correction that varies with light-emitting element brightness. This can be accomplished by providing a look-up table having a corrected code value for every possible brightness level for every light-emitting element but, as noted above, this is unrealistic in practical products. However, experiments performed by applicant have shown that the global corrections needed are often linear over a portion of the code value range. Hence, a variable global correction value can be implemented with a series of linear approximations to the desired curve. Referring to FIG. 4, the four most significant bits of the data value are provided to a variable global correction lookup table 50 to provide correction factors for code values within the range of the four most significant bits. The number of bits employed can be adjusted to suit the application. An additional integer adder/subtracter 52 may be provided with the multiplier to provide offsets in the output value. Likewise, the same data values may be optionally provided (shown by a dashed line) to the local correction look-up table to select an appropriate variable local correction value. However, the need for a more customized correction is less for the local correction, because the uniformity variation from the desired output level is, in general, lower. Moreover, the local correction table, because it has a separate value for each light-emitting element, will grow rapidly if multiple local correction values are associated with each light-emitting element. Hence, by employing a two-step correction, uniformity of an OLED display may be improved while reducing the overall hardware requirements.

It is important to consider a global correction separately from a local correction because of the nature of OLED devices. Variability in an OLED device comes from at least two sources: variability in the performance of the OLED light emissive materials, and variability in the electronics used to drive the light emissive materials. As has been observed by applicant in manufacturing processes, the variability in the light emissive materials tends to be global although not exclusively so, while variability in the electronics, for example thin-film driver circuits, tends to be local, although not exclusively so.

In typical applications, displays are sorted after manufacture, into groups that may be applied to different purposes. Some applications require displays having no, or only a few, faulty light-emitting elements. Others can tolerate variability but only within a range, while others may have different lifetime requirements. The present invention provides a means to customize the performance of an OLED display to the application for which it is intended. It is well known that OLED devices rely upon the current passing through them to produce light. As the current passes through the materials, the materials age and become less efficient. By applying a correction factor to a light-emitting element to increase its brightness, a greater current is passed through the light-emitting element, thereby reducing the lifetime of the light-emitting element while improving the uniformity.

The correction factors applied to an OLED device, according to one embodiment of the present invention, may be related to the expected lifetime of the materials and the lifetime requirements of the application for which the display is intended. The maximum combined correction factor may be set, e.g., so as to not exceed the ratio of the expected lifetime of the display materials to the expected lifetime of the display in the intended application. For example, if a display has an expected lifetime of 10 years at a desired brightness level, and an application of that display has a requirement of 5 years, the maximum combined correction factor for that display may be set so as not to exceed two, if the current-to-lifetime relationship is linear. If the relationship is not linear, a transformation to relate the lifetime and current density is necessary. These relationships can be obtained empirically. Hence, the combined correction factor for a display may be limited by application. Alternatively, one can view this relationship as a way to improve the yields in a manufacturing process by enabling uniformity correction in a display application (up to a limit) so that displays which might have been discarded, may now be used. Moreover, OLED devices having more-efficient light-emitting elements may have a reduced power requirement thereby enabling applications with more stringent power requirements.

The display requirements may be further employed to improve manufacturing yields by correcting the uniformity of specific light-emitting elements or only partially correcting the uniformity of the light-emitting elements. As noted above, some applications can tolerate a number of non-uniform light-emitting elements. These light-emitting elements may be chosen to be more or less noticeable to a user depending on the application and may remain uncorrected, or only partially corrected, thereby allowing the maximum combined correction factor to remain under the limit described above. For example, if a certain number of bad light-emitting elements were acceptable, the remainder may be corrected as described in the present invention and the display made acceptable. In a less extreme case, bad light-emitting elements may be partially corrected so as to meet the lifetime requirement of the display application and partially correcting the uniformity of the display. Hence, the global and local uniformity correction factors may be chosen to exclude light-emitting elements, or only partially correct light-emitting elements, that fall outside of a correctable range. This range, as observed above, may be application dependent.

There are a variety of ways in which light-emitting elements may be excluded from correction. For example, a minimum or maximum threshold may be provided outside of which no light-emitting elements are to be corrected. The threshold may be set by comparing the expected lifetime of the materials and the application requirements.

Figure 5:
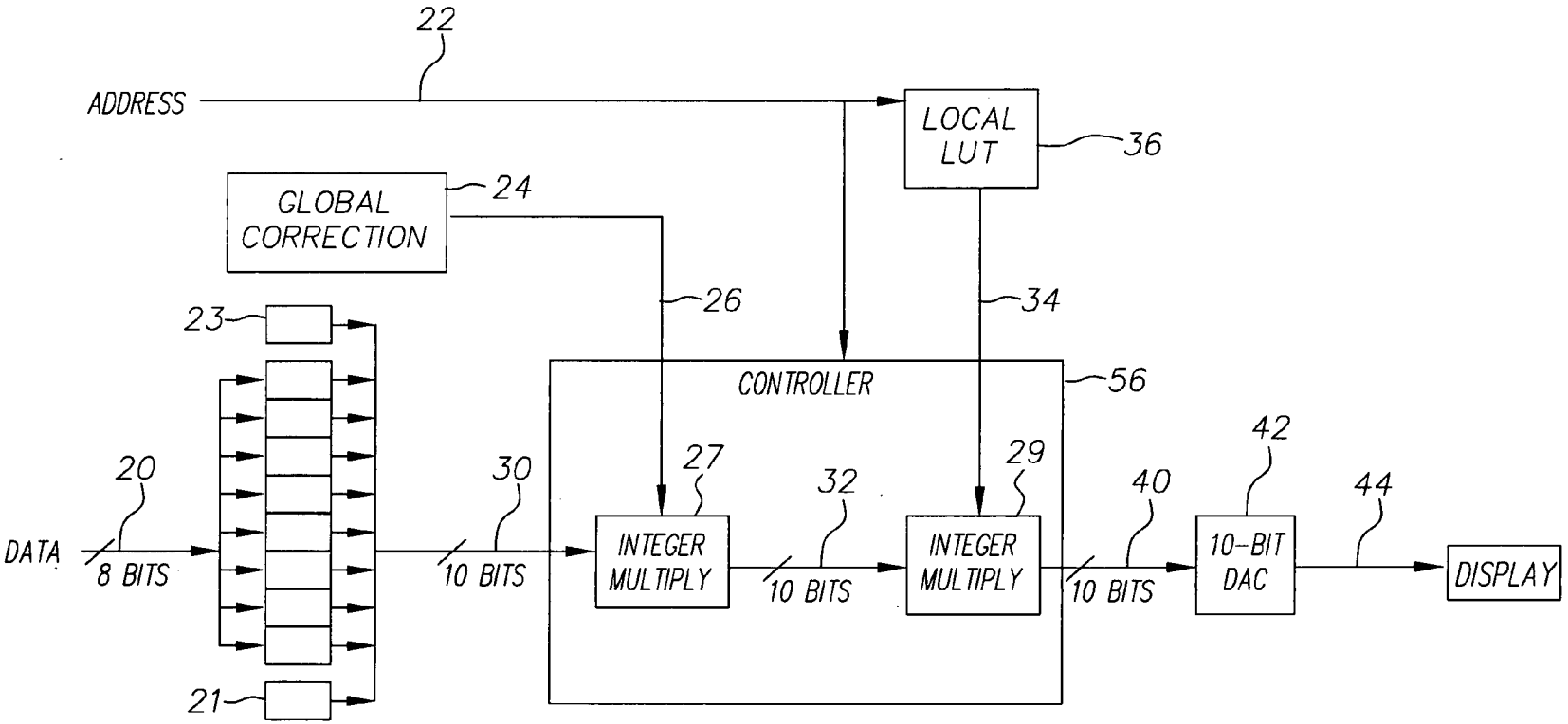

Depending on the hardware design of the correction circuitry, light-emitting elements that fall within an acceptable uniformity range may also be excluded. If for example, the required data rate and the signal bit-depth for a display were very high, the process of correcting the signal for every light-emitting element may be too expensive or time-consuming. In such a case, it can be useful to correct only those light-emitting elements that fall outside an acceptability range but inside a correctable threshold range. Referring to FIG. 5, this may be accomplished by providing a control circuit 56 that bypasses the correction calculation for specific addresses or for specific data values.

In an alternative embodiment of the present invention, a simplified correction mechanism may be employed to further reduce the complexity and size of the correction hardware. Applicant has determined that a large number of significant non-uniformity problems are associated with rows and columns of light-emitting elements. This is attributable to the manufacturing process. Rather than supplying an individual correction factor for every light-emitting element, correction factors for rows and columns might be employed. In this case, a global correction factor can be obtained as described above. However, the local correction factor is a combination of a row correction and a column correction. The row correction for each row may be a combination of the corrections for each row and the column correction for each column may be a combination of the corrections for each column. Suitable combinations include the average, maximum, or minimum of the corrections in each row or column. The corrections are best obtained by first calculating and applying one of the row or column corrections to the light-emitting elements in the display, and then obtaining the other.

Figure 6:
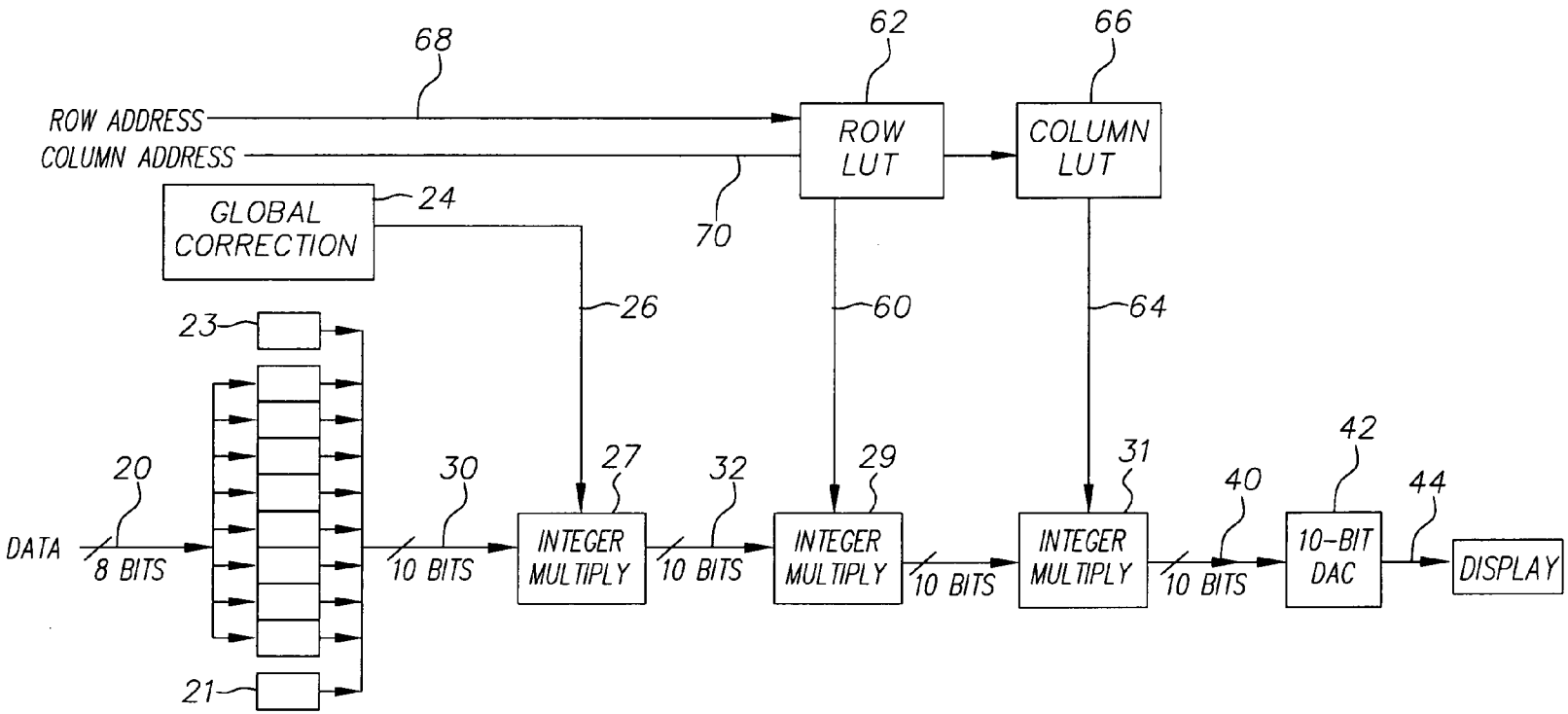

In operation, the global correction is applied as before. The local correction, however, is divided into two parts, a row correction and a column correction. Referring to FIG. 6, the row correction value 60 is found in a row address 68 look-up table 62 and applied to the integer multiplier 29. Similarly, the column correction value 64 is found in a column address 70 look-up table 66 and applied to another integer multiplier 31. The advantage of this arrangement, is that the required memory is greatly reduced. For a 256 by 256 color display, the row and column look-up tables each require only 256 entries for each color in comparison to the 256×256 entries in a local correction look-up table with a separate entry for each light-emitting element location. Thus, using this approach, an individual correction value could be applied for every brightness level for every light-emitting element by supplying a correction value for each brightness level for each row and each column. The global correction may be combined with the row and column corrections, further reducing the hardware requirement.

It is important for the driving circuitry (converter 42) to provide the correct range of voltage and/or current to drive the light-emitting elements at a level corresponding to the bit-depth of the corrected signal. For example, if the correction values are all unity, the brightness corresponding to the corrected digital output signal should be the same as the brightness corresponding to the digital input signal. In other words, the driving circuitry needs to accommodate the expected range of code values and driving levels. Moreover, according to the present invention, some of the light-emitting elements may require a greater voltage and/or current to provide a corrected output having improved uniformity. Therefore, the driving circuitry must have additional range so that it can provide greater power to dimmer light-emitting elements. If no additional range is available in the driving circuitry, that is the circuit is driving light-emitting elements at the maximum value before the light-emitting elements are corrected, then either the light-emitting element cannot be corrected or the overall brightness of the display must be reduced.

Figure 7:
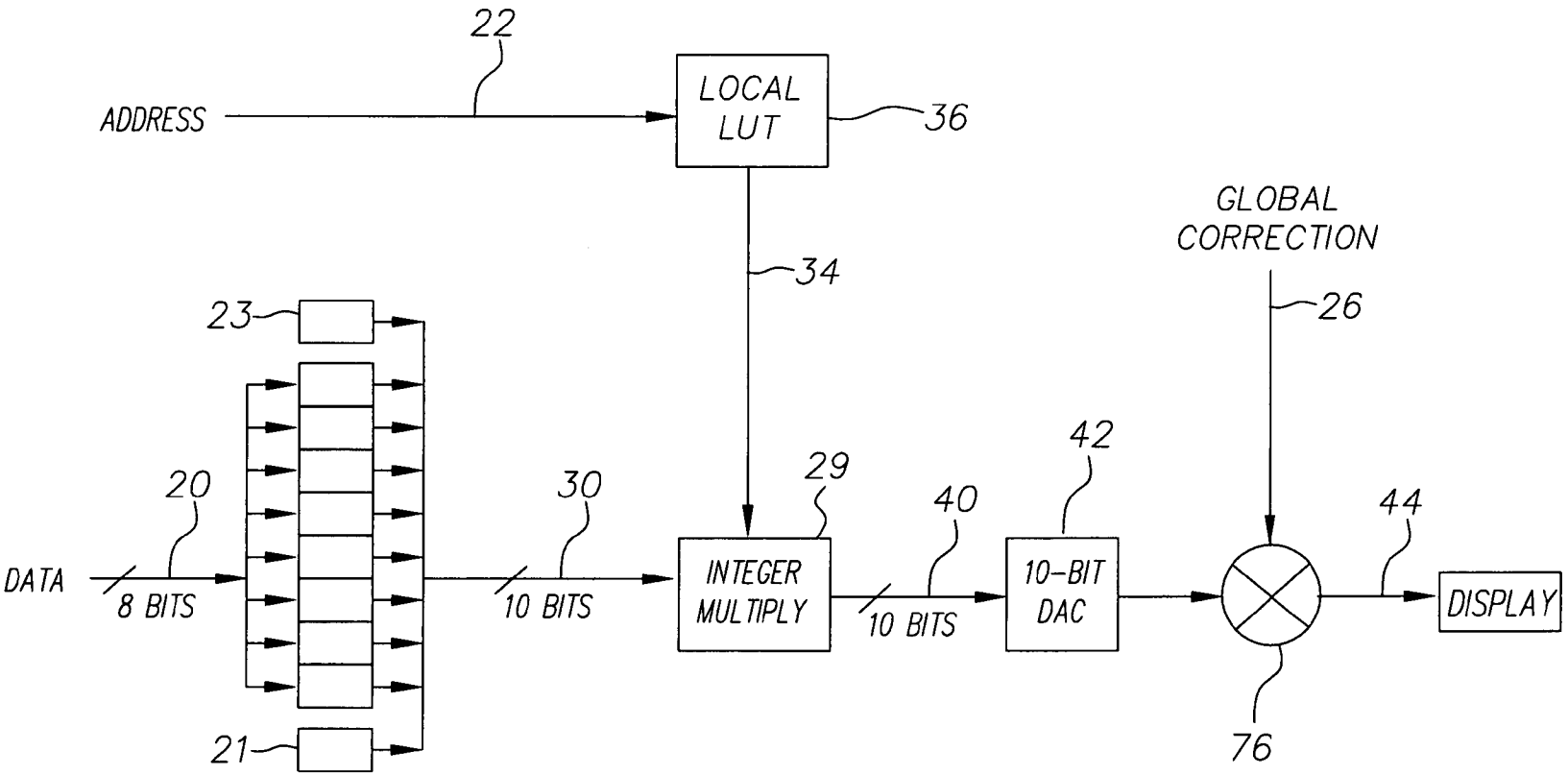
Figure 8:
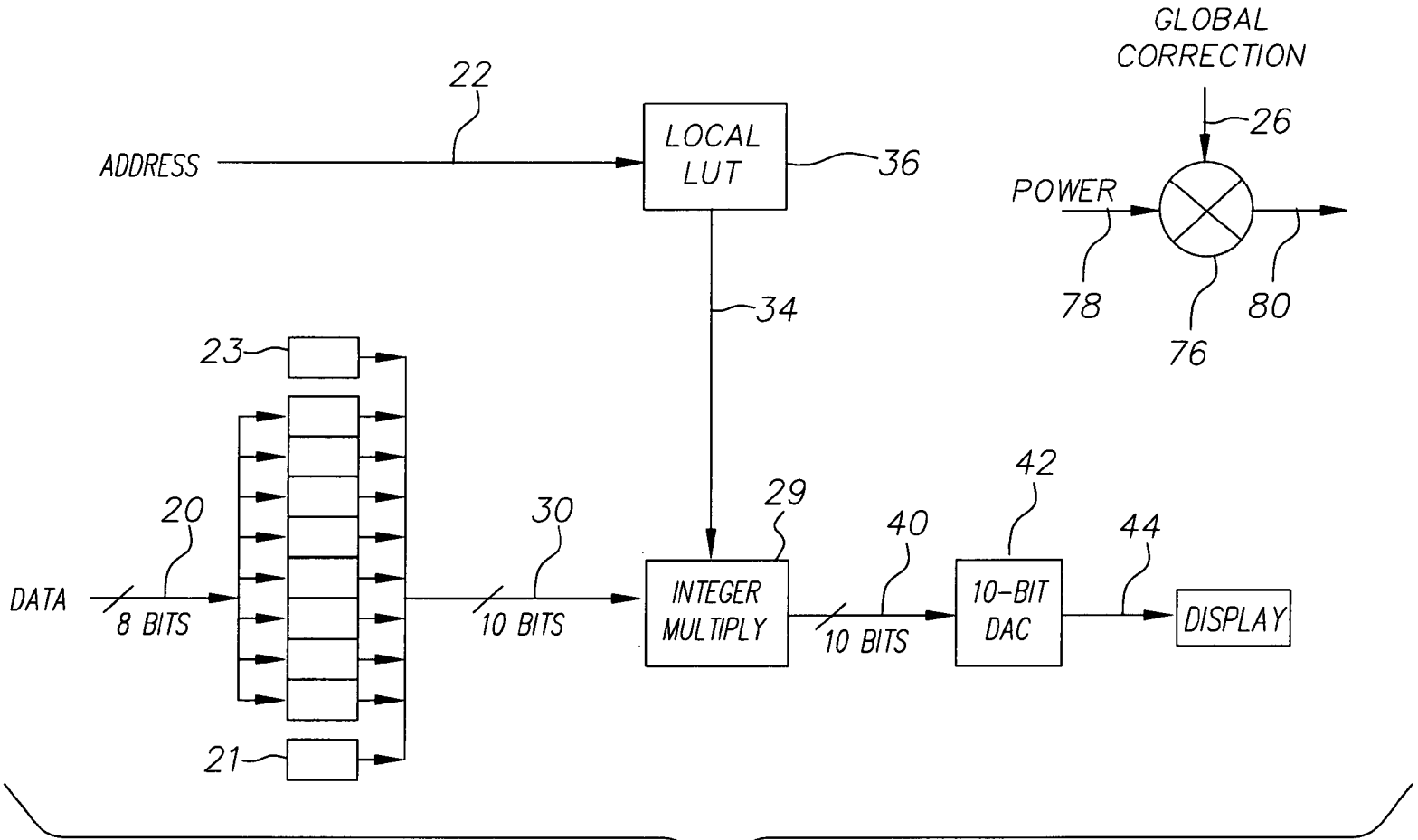

The global correction factor 26 may be applied in analog circuitry after the local correction. Referring to FIG. 7, a global analog correction 76 is provided. This technique may be combined with that shown in FIG. 2, so that both an analog global compensation is provided and a local digital code value correction is performed. This correction may be applied either within a controller or, for example, within the display. In a further embodiment, the analog correction may be provided in the power circuitry, e.g., the global correction can be provided by adjusting a common power signal to the display. An increase in the power provided to light-emitting elements in a display can be accommodated by increasing the voltage or current provided to the OLED elements in the display. Referring to FIG. 8, a global power correction 82 is provided. Power signal 78 is scaled according to a global correction factor 26 to produce a corrected power signal 80 that is supplied in common to all light-emitting elements. This correction can be done manually, for example with a potentiometer, or under the control of a digital circuit. The power analog global compensation is combined with a local digital code value correction.

The invention has been described in detail with particular reference to certain preferred embodiments thereof, but it will be understood that variations and modifications can be effected within the spirit and scope of the invention.

PARTS LIST

8 Provide display step
10 Input signal step
12 Transform signal step
14 Global correction step
16 Local correction step
18 output correction step
20 digital input data signal
21 bit
22 address value
23 bit
24 memory
26 global correction factor
27 integer multiplier
29 integer multiplier
30 larger bit-depth digital data signal
31 integer multiplier
32 globally corrected signal
34 local correction value
36 look-up table
40 corrected digital signal
42 digital-to-analog converter
44 driving signal
46 combined look-up table
48 combined correction value
50 global correction look-up table
52 integer adder/subtractor
56 control circuit
60 row correction value
62 look-up table
64 column correction value
66 look-up table
68 row address
70 column address
76 global analog correction
78 power signal
80 corrected power signal
82 global power correction

What is claimed is:

1. A method for a correction of brightness and uniformity variations in OLED displays, comprising:

a) providing an OLED display having a plurality of light-emitting elements with a common power signal and local control signals;

b) providing a digital input signal for displaying information on each light-emitting element, the signal having a first bit depth;

c) transforming the digital input signal into a transformed digital signal having a second bit depth greater than the first bit depth; and d) correcting the transformed signal for one or more light-emitting elements of the display by applying a local correction factor to produce a corrected digital signal.

2. The method of claim 1, further comprising providing a global correction factor for all light-emitting elements and correcting the transformed signal by the global correction factor in combination with the local correction factor to produce the corrected digital signal.

3. The method of claim 2, wherein correction of the transformed signal is performed by integer scaling.

4. The method of claim 2, wherein the global and local corrections are performed with a combined correction factor to produce the corrected digital signal.

5. The method of claim 2, wherein the global and local corrections are performed with in separate steps with separate correction factors to produce the corrected digital signal.

6. The method of claim 2 further comprising a step of calculating an average brightness of the display with a nominal digital input signal and wherein the global correction factor is a multiplication factor equal to a desired brightness of the display at the nominal digital input signal divided by the average brightness of the display at the nominal digital input signal.

7. The method of claim 6 further comprising a step of calculating the local correction factor for a light-emitting element with the nominal digital input signal and wherein the local correction factor is a multiplication factor equal to the desired brightness of the light-emitting element at the nominal digital input signal divided by the brightness of the globally corrected light-emitting element at the nominal digital input signal.

8. The method of claim 1 further comprising a step of calculating the local correction factor for a light-emitting element with a nominal digital input signal and wherein the local correction factor is a multiplication factor equal to a desired brightness of the display at the nominal digital input signal divided by the brightness of the light-emitting element at the nominal digital input signal.

9. The method of claim 1 wherein the transformation is a multiplication of the digital input signal by a factor of two.

10. The method of claim 1 wherein the plurality of light-emitting elements are organized and controlled by rows and columns and a single, common local correction factor is applied to each light-emitting element in a row or column of light-emitting elements.

11. The method of claim 10 wherein the single, common local correction factor applied to a light-emitting element in a row or column of light-emitting elements is the average, maximum, or minimum of the local correction factors of the light-emitting elements in the row or column.

12. The method of claim 10 wherein a single, common row local correction factor is first applied to each light-emitting element in a row of light-emitting elements and a single, common local correction factor is then calculated and applied to each light-emitting element in a column of light-emitting elements.

13. The method of claim 10 wherein a single, common column local correction factor is first applied to each light-emitting element in a column of light-emitting elements and a single, common local correction factor is then calculated and applied to each light-emitting element in a row of light-emitting elements.

14. The method of claim 1 wherein a plurality of corrections are provided for each light-emitting element for a corresponding plurality of brightness levels.

15. The method of claim 14 wherein the corrections are scaling factors stored in a look-up value in a table.

16. The method of claim 1 wherein the OLED display is a color display comprising light emitting elements of multiple colors, and further comprising providing a separate global correction factor for all light-emitting elements of a common color and correcting the transformed signal for each light-emitting element by the common color global correction factor in combination with the local correction factor to produce the corrected digital signal.

17. The method of claim 1, further comprising converting the corrected digital signal to an analog signal, and providing a global correction factor for the analog signal.

18. The method of claim 17, wherein the OLED display is a color display comprising light emitting elements of multiple colors, and wherein separate global correction factors are provided for all light-emitting elements of a common color.

19. The method of claim 1, further comprising providing a global power correction factor for the common power signal.

20. The method of claim 19, further comprising adjusting the common power signal based on a relative lifetime of display materials and an application requirement.

21. The method of claim 1 further comprising the step of providing a uniformity threshold below which the local correction is applied and above which the local correction is not applied.

22. The method of claim 21 wherein the uniformity threshold is selected based on a relative lifetime of display materials and an application requirement.

23. The method of claim 1 further comprising a step of providing an acceptability threshold below which the local correction is not applied and above which the local correction is applied.

24. The method of claim 1 further comprising correcting a plurality of displays and a step of sorting the corrected OLED displays based on a relative lifetime of display materials and an application requirement.

25. The method of claim 1, wherein correction of the transformed signal is performed by integer scaling.

26. The method of claim 1 wherein the first bit depth is 8 bits.

27. The method of claim 26 wherein the second bit depth is 10 bits.

28. A method for a correction of brightness and uniformity variations in OLED devices and improving manufacturing yields of the OLED devices, comprising:

a) providing an OLED device having a plurality of light-emitting elements having a nominal lifetime and a nominal brightness at a nominal drive current density and one or more non-uniform light-emitting elements that do not produce the nominal brightness at the nominal drive current density;

b) providing an application for the OLED device having a required lifetime lower than the nominal OLED device lifetime; and c) driving the one or more non-uniform light-emitting elements in the OLED device at a current density higher than the nominal drive current density so that the nominal brightness is achieved.

* * * * *